US005901812A

United States Patent [19]

Meunier

[11] Patent Number: 5,901,812

[45] Date of Patent: May 11, 1999

[54] LIFT FOR DISABLED PERSONS

[75] Inventor: Richard A. Meunier, Edmonton, Canada

[73] Assignee: Trus [T] Lift Corp., Edmonton, Canada

[21] Appl. No.: 08/838,226

[22] Filed: Apr. 17, 1997

[51] Int. Cl.[6] ..... B66B 9/08

[52] U.S. Cl. ..... 187/200; 414/921

[58] Field of Search ..... 187/200, 267, 187/244, 240; 414/921; 182/141; 254/95

[56] References Cited

U.S. PATENT DOCUMENTS

| | | | |
|---|---|---|---|
| 2,486,591 | 11/1949 | Ferrante | 200/157 |
| 2,527,897 | 10/1950 | Todd | 187/25 |
| 2,828,379 | 3/1958 | Simonds | 200/86.5 |
| 3,468,401 | 9/1969 | Letz | 187/25 |
| 3,661,228 | 5/1972 | Glasser | 187/25 |
| 3,935,410 | 1/1976 | Howard | 200/333 |
| 4,133,437 | 1/1979 | Gates | 414/75 R |
| 4,172,217 | 10/1979 | Miller | 200/86.5 |
| 4,281,744 | 8/1981 | Koerber | 187/9 R |
| 4,283,803 | 8/1981 | Krumbeck | 4/496 |
| 4,306,132 | 12/1981 | Henville | 200/332 |
| 4,353,436 | 10/1982 | Rice et al. | 187/200 |
| 4,919,236 | 4/1990 | Karisson | 187/25 |
| 5,499,694 | 3/1996 | Dorn | 187/200 |

FOREIGN PATENT DOCUMENTS

| | | |
|---|---|---|
| 291699 | 7/1929 | Canada . |
| 637165 | 2/1962 | Canada . |
| 0 739 852 A2 | 10/1996 | European Pat. Off. . |

*Primary Examiner*—Kenneth Noland
*Attorney, Agent, or Firm*—Kent & Edgar Sixbey, Friedman, Leedom, & Ferguson PC

[57] ABSTRACT

In a vertical lift for use in exterior locations to raise and lower a person, the lift comprising a support frame, a tower frame mounted on the support frame, a carriage secured to the tower frame so as to be vertically movable with respect thereto, a drive system associated with the tower frame to raise and lower the carriage between an upper and a lower position, and control means to enable a person using the lift to activate and deactivate the drive system as required, the improvement characterized in that the tower frame comprises a plurality of vertically extending guides secured to the tower frame and a carriage guide frame secured to the carriage and movably associated with the guides, and the drive system comprises a vertically oriented drive screw which, when activated, rotates in one direction to raise or in the opposite direction to lower a nut seated thereon so as not to rotate therewith, the guide frame supported by the nut for raising or lowering therewith. The lift according to the present invention is well suited as an exterior vertical lift for lifting disabled persons from the ground level up to a higher, main floor level of a building.

19 Claims, 7 Drawing Sheets

LIFT FOR DISABLED PERSONS

FIELD OF THE INVENTION

The present invention relates to a vertical lift for use in raising and lowering persons, and more particularly to a lift for disabled persons, for instance in a wheelchair, that is particularly suitable for exterior locations.

BACKGROUND OF THE INVENTION

Vertical lifts such as wheelchair lifts for disabled persons are well-known. Representative of known wheelchair lifts is U.S. Pat. No. 3,661,228 of Glasser issued May 9, 1972 which describes and illustrates a screw driven platform which is selectively adjustable to a lowered wheelchair loading and unloading position and a raised curb position. A manually operable toe plate serves as a ramp, when in lowered position, and an obstruction to confine the wheelchair to the platform when in raised position. The platform is raised and lowered by means of a pair of screw drives seated within tubular housings. They drive a pair of C-shaped traveller brackets which are directly secured to a beam which is part of the frame structure of the lift platform. Controls for the platform are permanently mounted near the motor.

Other wheelchair lift constructions are described and illustrated in U.S. Pat. Nos. 4,133,437 of Gates issued Jan. 9, 1979; 4,281,744 of Koerber issued Aug. 4, 1981 and 4,283,803 of Krumbeck issued Aug. 18, 1981 and European Patent Application of David Paul Erlam, et al published under EP 0 739 852 A2 on Oct. 30, 1996.

Other references of background interest relating generally to screw driven elevators include Canadian Patent No. 291,699 issued Jul. 30, 1929 of Kreutzkamp and U.S. Pat. Nos. 3,468,401 of Letz issued Sep. 23, 1969, 2,527,897 of Todd issued Oct. 31, 1950 and 4,919,236 of Karisson et al issued Apr. 23, 1990

Of background interest relating to switch actuators for incapacitated persons or otherwise include U.S. Pat. Nos. 2,486,591 of Ferrante issued Nov. 1, 1949; 2,828,379 of Simonds et al issued Mar. 25, 1958; 3,935,410 of Howard issued Jan. 27, 1976; 4,306,132 of Henville issued Dec. 15, 1981; 4,172,217 of Miller issued Oct. 23, 1979, as well as Canadian Patent No. 637,165 of Holden issued Feb. 27, 1962.

Most of these known lifts for disabled persons and persons in wheelchairs, as well as the previously described lifts, appear to be extremely complex in construction and hence expensive to build. Many of these constructions are suitable for an indoor location but would be completely inadequate for an exterior location where rain, snow, ice, leaves and other things may seriously hamper their effective operation.

It is thus an object of the present invention to provide a vertical lift for use by disabled persons and others, that is suitable for use in exterior locations, and which is economical to make and both reliable and secure in operation. It is a further object of the present invention to provide such a lift which is simple to put in place or remove. It is yet a further object of the present invention to provide such a lift which is both easy and safe for a disabled person to operate.

SUMMARY OF THE INVENTION

In accordance with the present invention there is provided a vertical lift for use in exterior locations to raise and lower a person. The lift is of the type which comprises a support frame, a tower frame mounted on the support frame, a carriage secured to the tower frame so as to be vertically movable with respect thereto, a drive system associated with the tower frame to raise and lower the carriage between an upper and a lower position, and control means to enable a person using the lift to activate and deactivate the drive system as required. The invention is more particularly characterized in that the tower frame comprises a plurality of vertically extending guides secured to the tower frame and a carriage guide frame secured to the carriage and movably associated with the guides. The drive system comprises a vertically oriented drive screw which, when activated, rotates in one direction to raise or in the opposite direction to lower a nut seated thereon so as not to rotate therewith. The guide frame is supported by the nut and is raised or lowered therewith.

In a preferred embodiment a stop is provided to prevent further lowering of the guide frame when the carriage has reached its lower position and a means is provided to continue rotation of the drive screw in one direction and lower the nut further, beyond its lowest position supporting the guide frame, after the carriage has reached that lower position, to enable rotation of the drive screw in the opposite direction and raising of the nut for a short period of time before the nut comes into a position supporting the guide frame, whereby a zero load start for the drive screw is provided when lifting the guide frame and carriage.

The controls are carriage mounted to move therewith relative to the tower.

Furthermore, it is preferred that the up and down switches are each biased to one position and those switches operate to activate the drive system only when they are held, against the bias, in another position. The lever pads cover the up and down control switches and minimize exposure of those switches to precipitation and other environmental conditions.

In yet a further preferred embodiment, a toe plate is secured to an edge of the carriage to provide a ramp for easy exit from and entry to the carriage. The toe plate is foldable between an upper position obstructing exit from and entry to the carriage, and a lower ramp position, flush with the upper surface of the platform.

The means to automatically lift the toe plate to its upper position and hold it there while the carriage is between its upper and lower positions and to automatically lower the toe plate when the carriage arrives at its lower position is provided in the form of a roller lever secured to the toe plate and a cam surface on a guide bar on which the roller lever acts, the cam surface constructed so as to cause the roller lever to orient the toe plate in proper position depending upon the vertical position of the carriage.

The lift according to the present invention is well suited as an exterior vertical lift for lifting disabled persons from the ground level up to a higher, main floor level of a building. The lift is both simple and therefore relatively inexpensive in its construction, and stable and reliable in its operation even in external conditions where snow and ice or other factors may impede the operation of conventional lifts.

BRIEF DESCRIPTION OF THE DRAWINGS

These and other advantages of the invention will become apparent upon reading the following detailed description and upon referring to the drawings in which.

Figure 1:
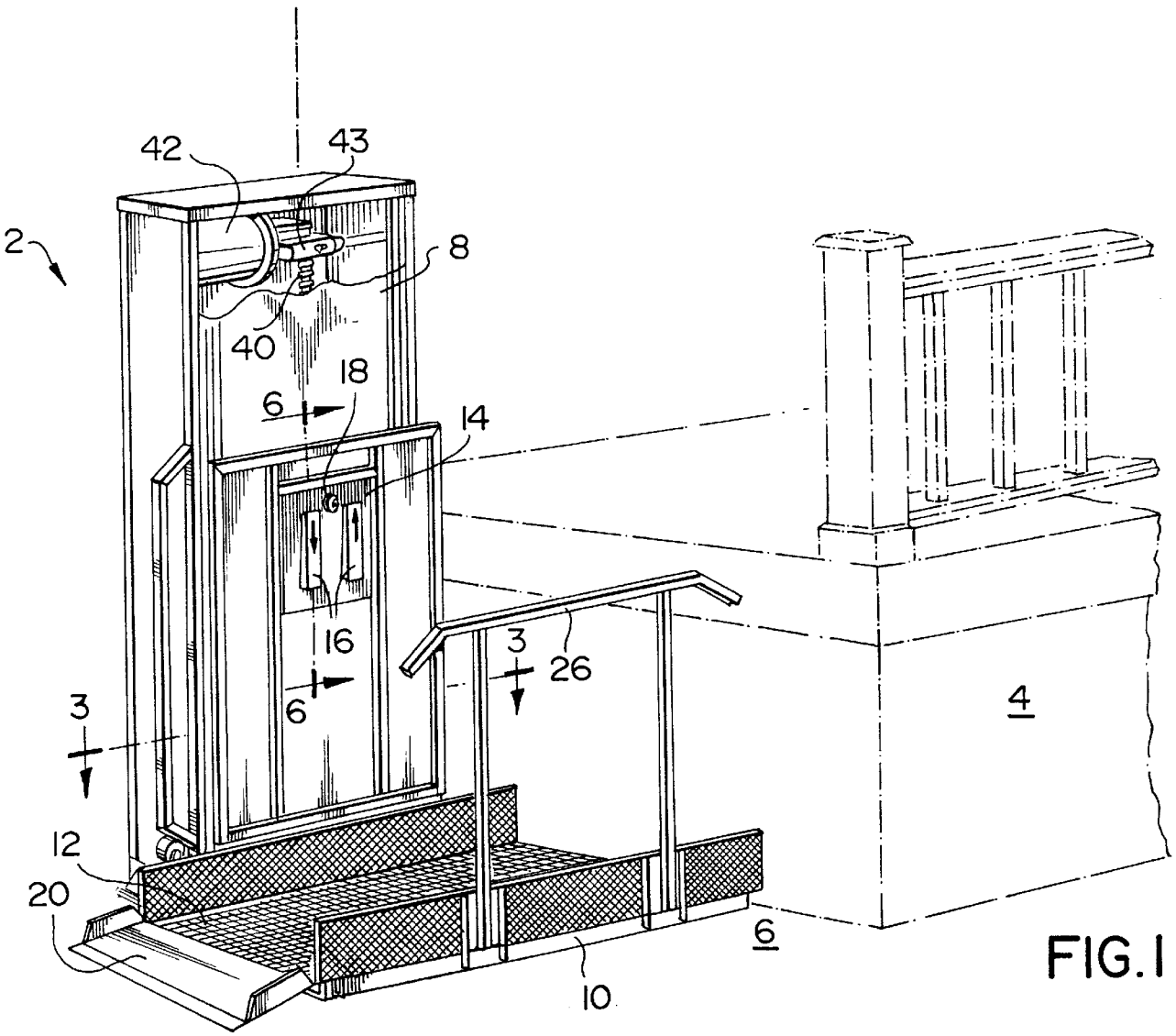
FIG. 1 is a perspective view of a lift in accordance with the present invention installed by the side of an outside porch at the entrance way to a house.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to FIG. 1 there is illustrated a lift 2 positioned beside a porch 4 for lifting, for example, a disabled person in a wheelchair, between the level of porch 4 and the level of ground 6. Lift 2 is made up of three main components, namely tower 8, base frame 10 (FIG. 2) and carriage or platform 12. These components can be handled by one person and will move easily through gates and door openings. Carriage 12 is preferably made from an expanded, see-through metal as illustrated. This eliminates snow and ice build-up, for external applications of lift 2, while allowing the user to have full visibility of what is beneath the platform. There is no onsite wiring required and the complete installation of lift 2 can normally be completed in less than thirty minutes. Control panel 14 is mounted on tower 8 so as to rise and fall with carriage 12. As will be described in more detail subsequently, the operation of lift 2 is electrically controlled. Accordingly, on control panel 14 are mounted up and down control pads 16. An emergency stop and lock out button 18 is also provided, this button providing access to an emergency stop switch (not illustrated) and a key lock up of the unit which prevents the unit from being operated when in the locked position.

Figure 2:
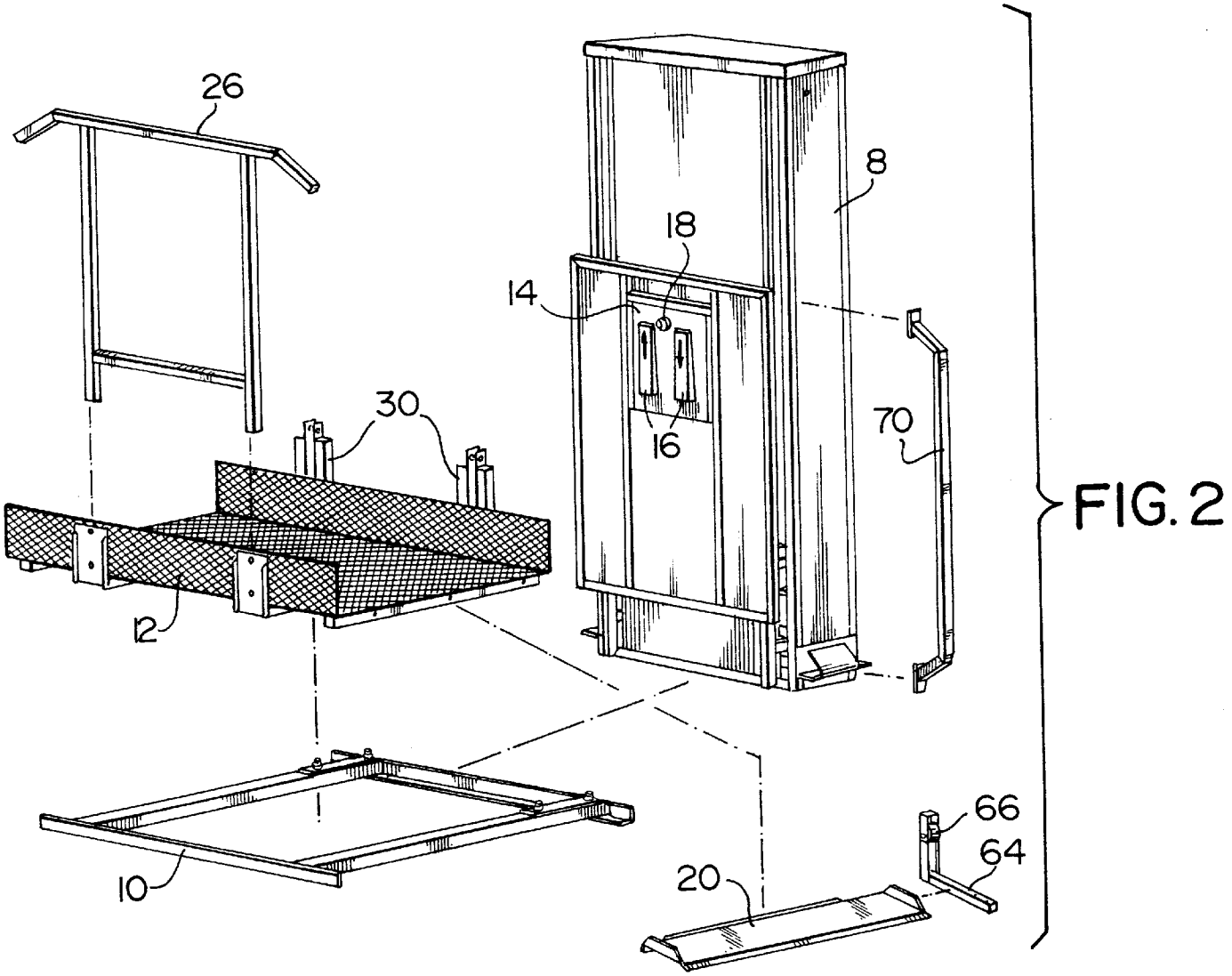
FIG. 2 is an exploded view of the lift of FIG. 1 illustrating its main components when assembled on site.
Figure 3:
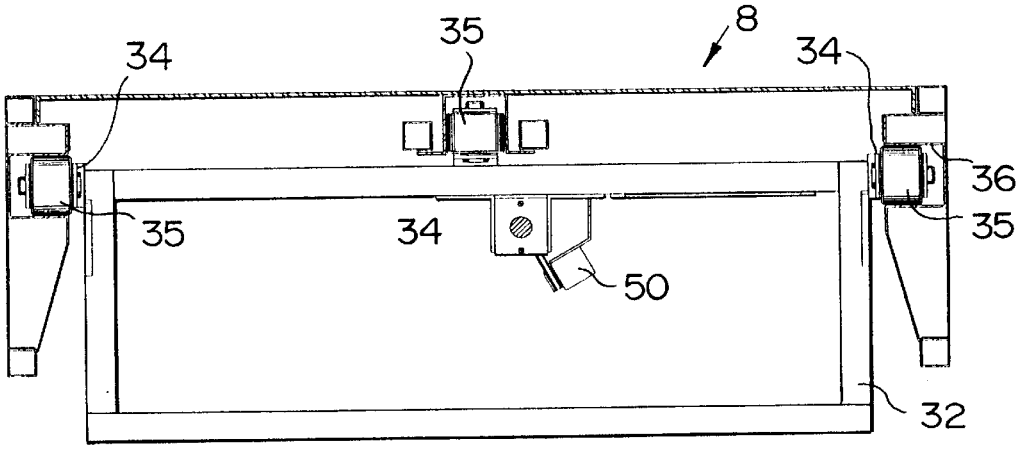
FIG. 3 is a plan section view of the lift along line III—III of FIG. 1.
Figure 4:
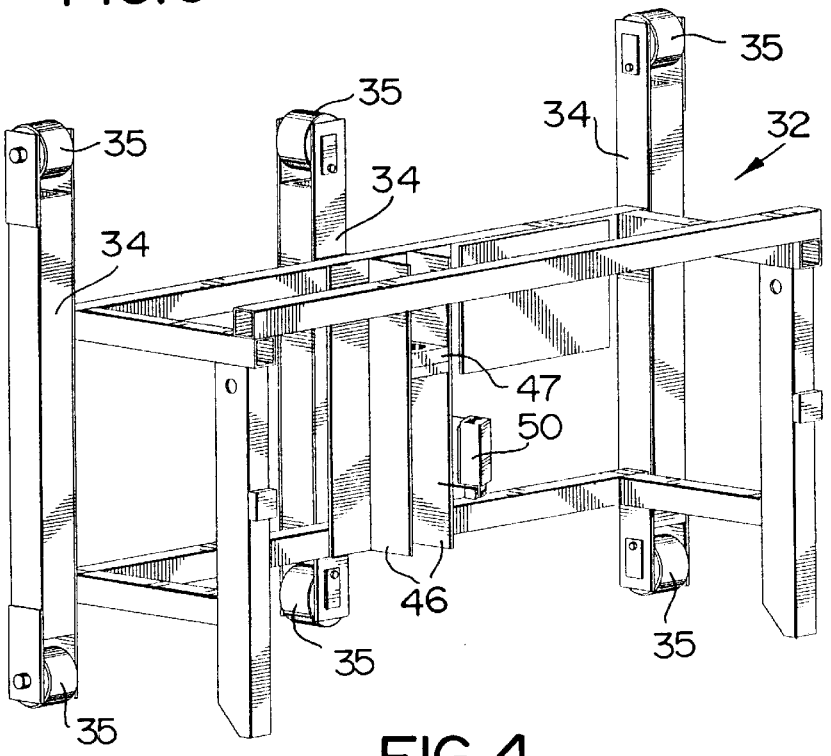
FIG. 4 is a perspective view of the carriage guide frame of the lift in accordance with the invention, shown as a separate component.

A foldable toe plate 20, the operation of which will be described in more detail subsequently, is pivotally secured to the exit and entry side of platform 12, and provides a ramp for easy entry and exit, when in its down position as illustrated, or a wall to block a wheelchair on the carriage 12 from rolling off that side of the platform when in raised position. Also secured to carriage 12 is a hand rail 26. As can be seen in FIG. 2, tower 8 is releasably secured, for example by nut and bolt means (not illustrated), to base frame 10. Carriage 12 is bolted at braces 30 to carriage guide frame 32 (FIG. 4). As can be seen in FIGS. 3 and 4, carriage guide frame 32 is vertically movable, together with carriage 12, up and down tower 8 by means of roller arms 34 with rollers 35 at their extremities, vertically secured to peripheral portions of carriage guide frame 32 as illustrated. Roller arms 34 slide up and down within vertical U-shaped channels 36 forming part of the frame of tower 8. Roller arms 34 fit in close tolerance within vertical channels 36. This fact together with the positioning of the roller arms 34 about the periphery of carriage guide frame 32, and the orientation of channels 36, ensures that the horizontal movement of the rollers, and hence of carriage guide frame 32 and carriage 12, is kept to a minimum while still allowing enough clearance for the rollers to roll freely. The rollers 35 are preferably made from a polyurethane plastic bearing material that has a lubricant graphite embedded into the plastic. This allows the rollers to operate virtually maintenance free.

The up and down movement of carriage guide frame 32 and carriage 12 is accomplished by a single drive screw 40 which is vertically mounted within tower 8 (e.g. FIGS. 1, 3, 5*a* and 5*b*) and driven by a electric motor 42, power from which is transmitted to drive screw 40 by means of gear reducer 43. A mechanical leg crank arrangement (not shown) may be provided to permit manual turning of the drive screw to lift or lower the carriage guide frame 32 and carriage 12 in case of a power outage or motor misfunction. The direction of operation of motor 42, and hence the direction of rotation of drive screw 40 is governed by up and down control pads 16. A nut 44, mounted on drive screw 40 and prevented from rotation by angles 46 secured to guide frame 32 (FIGS. 5*a* and 5*b* for example), travels up or down drive screw 40 depending on the direction of rotation of drive screw 40. As nut 44 moves up drive screw 40, it bears against a bearing surface 47 of carriage guide frame 32, and thereby carries with it carriage guide frame 32 to lift carriage 12 in an upward direction. When drive screw 40 is rotated in the opposite direction, nut 44 descends on drive screw 40, thereby lowering carriage guide frame 32 and carriage 12.

Figure 5A:
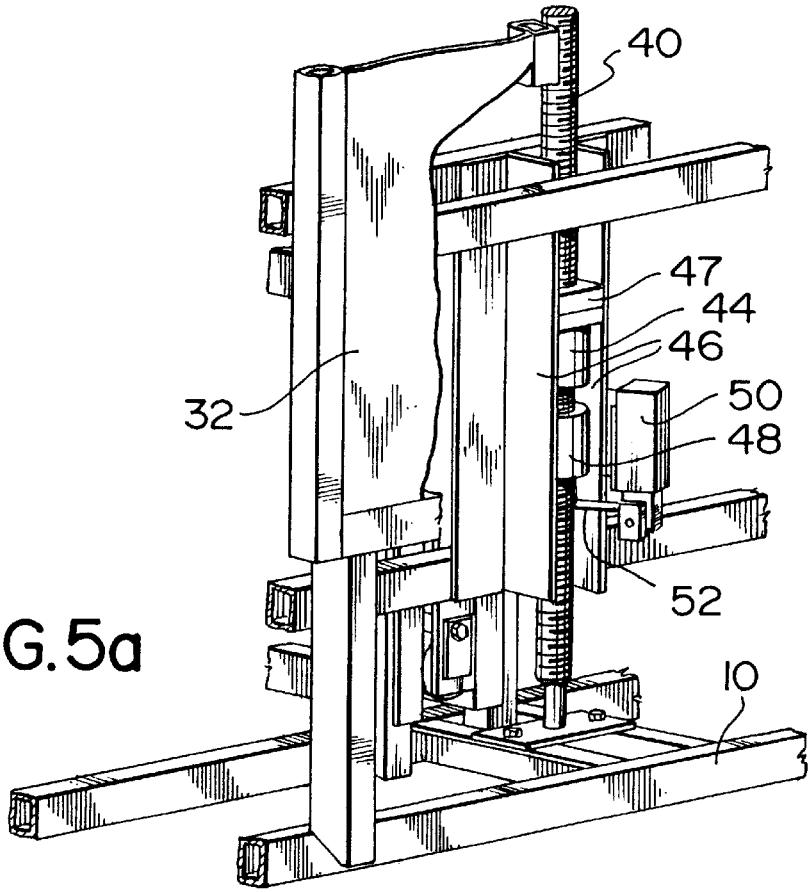
FIGS. 5*a* and 5*b* are perspective, partial views of the screw drive system of the lift of FIG. 1, with the carriage frame in lowered position, both at the time the carriage guide frame reaches that position during downward movement of the carriage (FIG. 5*a*) and shortly after that time, as the rotation of the drive screw is about to be terminated.
Figure 5B:
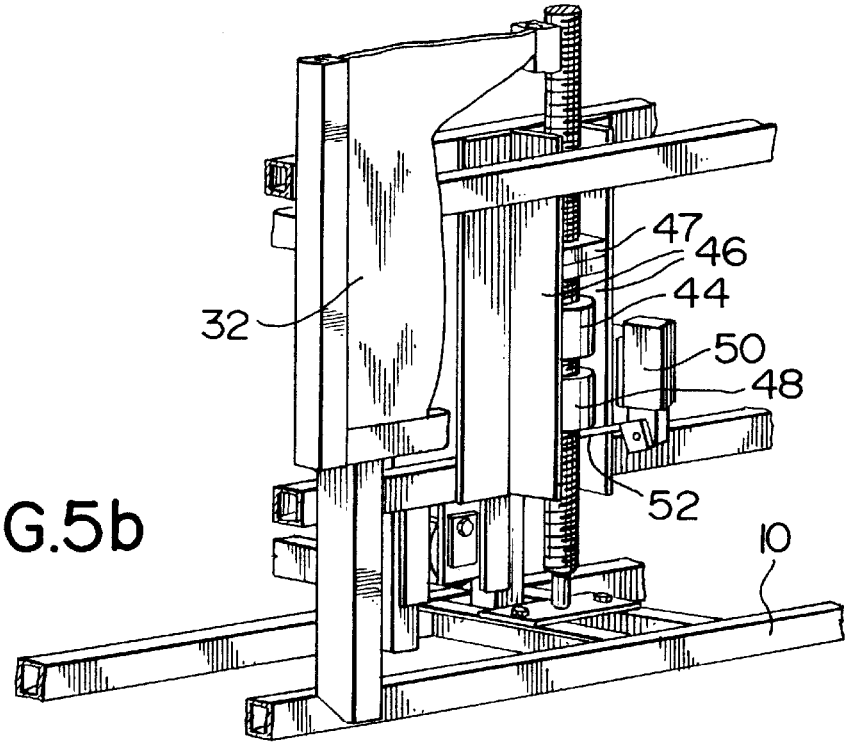

Because lift 2 is designed to operate in extremely cold climatic conditions, where extra friction may exist because of the cold, lift 2 of the present invention has been designed so that, when the carriage 12 is being lifted, drive screw 40 commences its rotation (in the lift direction) with no load on it. This feature is illustrated in FIGS. 5*a* and 5*b*. More particularly, a switch 50, designed to deactivate motor 42 after carriage 12 has reached its lower limit, cooperates with nut 48, through operator rod 52 which activates switch 50, so that nut 48 (also prevented from rotation by angles 46 of guide 32) is positioned to contact operator rod 52 and activate switch 50 only after carriage 12 has stopped its lower descent (for example by resting on base frame 10) and after drive screw 40 has continued to rotate after that point to lower nut 44 approximately one-half inch below bearing surface 47. At that point, nut 48 comes in contact with operator rod 52, activating switch 50 which then deactivates motor 42 so that the rotation of drive screw 40 terminates. This allows for a zero load, free wheeling start for about (for instance) two to three seconds when the lift 2 is activated in the left direction, since nut 44 must be raised this one-half inch distance before it comes into contact with the bearing surface 47 to commence lifting of carriage guide frame 32 and carriage 12.

Figure 6A:
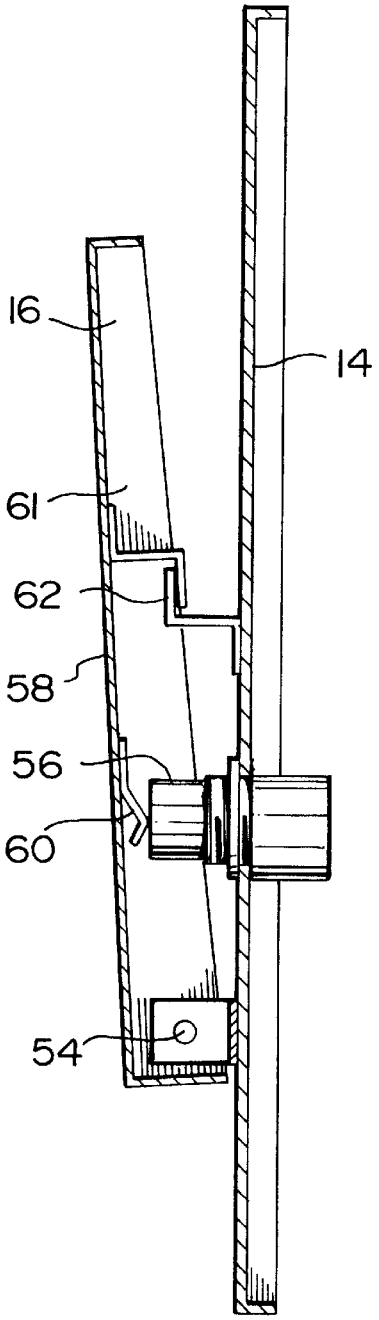
FIGS. 6*a* and 6*b* are section views of the operating control pads of the device of FIG. 1, along line VI—VI, shown respectively in inoperative (FIG. 6*a*) and operative (FIG. 6*b*) positions.
Figure 6B:
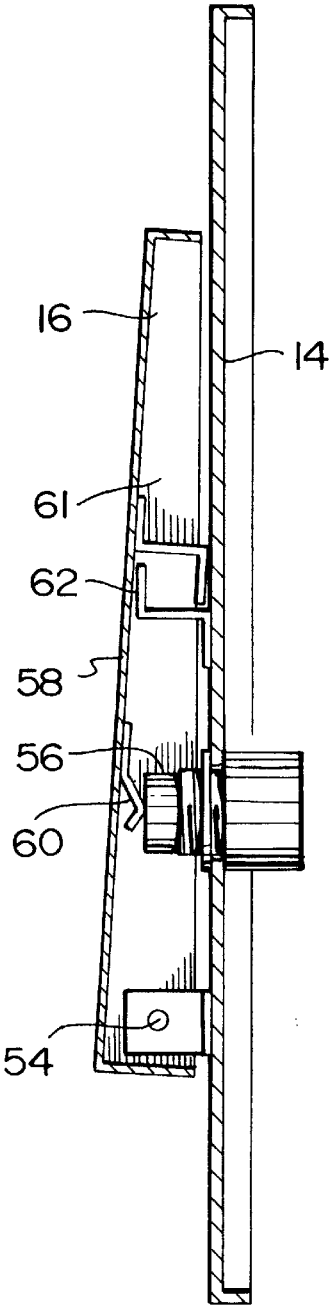

Another feature of the present invention, which makes it suitable for external use, lies in the construction and operation of up and down control pads 16. As can be seen in FIGS. 6*a* and 6*b,* each of these pads pivots about a point 54 located on the control panel 14 below its corresponding switch 56. Switches 56 are normally biased in an off, up position, as illustrated in FIG. 6*a*. By pushing in on pad 16 on virtually any portion of the large cover surface 58, below switch 56, protrusion 60 on the inside surface of cover 58 bears down on switch 56 to depress it against its outward bias, as illustrated in FIG. 6*b*. So long as switch 56 is depressed, the designed movement of carriage 12 for that particular control pad (up or down) is carried out until either the switch is allowed to return to its up position, by removing the pressure on the pad 16, or until the carriage 12 reaches its upper or lower limit of travel. Appropriate stop mechanisms of a conventional nature (and hence not illustrated) have been included in the drive system at those limits. This particular arrangement of pivoting pad with a wide cover 56, as well as circumscribing side skirt 61, also protects switch 56 and pivot 54 from snow or ice or other forms of build up or debris which might interfere with the operation of switch 56. A stop arrangement 62 prevents pad 16 from pivoting outwardly beyond a limited degree, so that pad 16 and protrusion 60 are in position and ready for use.

Figure 7A:
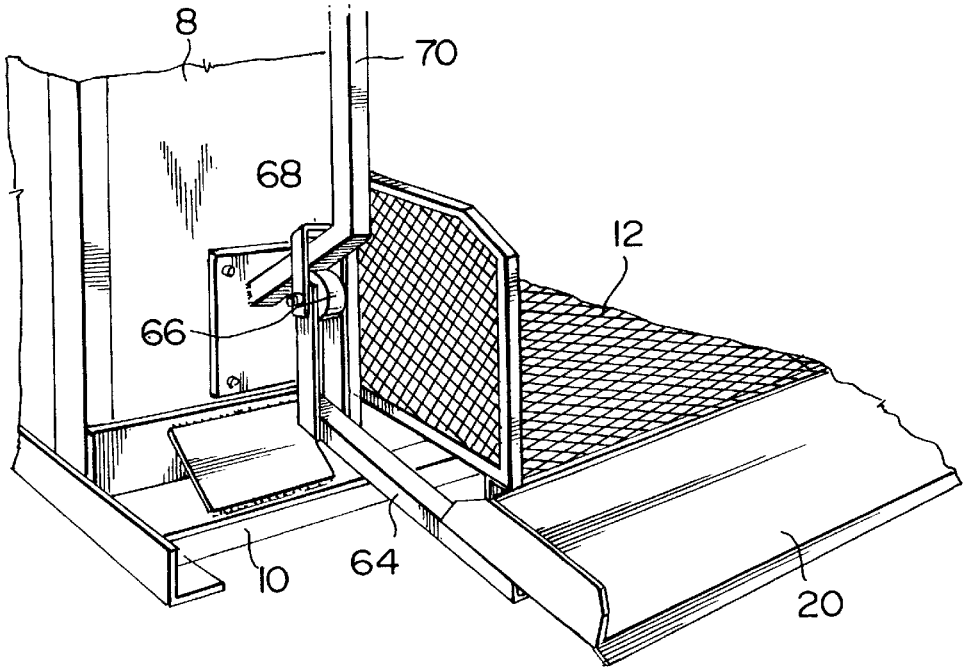
FIGS. 7*a,* 7*b* and 7*c* are perspective, partial views of the carriage showing the toe plate, toe plate roller lever and toe plate roller guide when the carriage is in its lower position (FIG. 7*a*), intermediate position (FIG. 7*b*) and raised position (FIG. 7*c*).
Figure 7B:
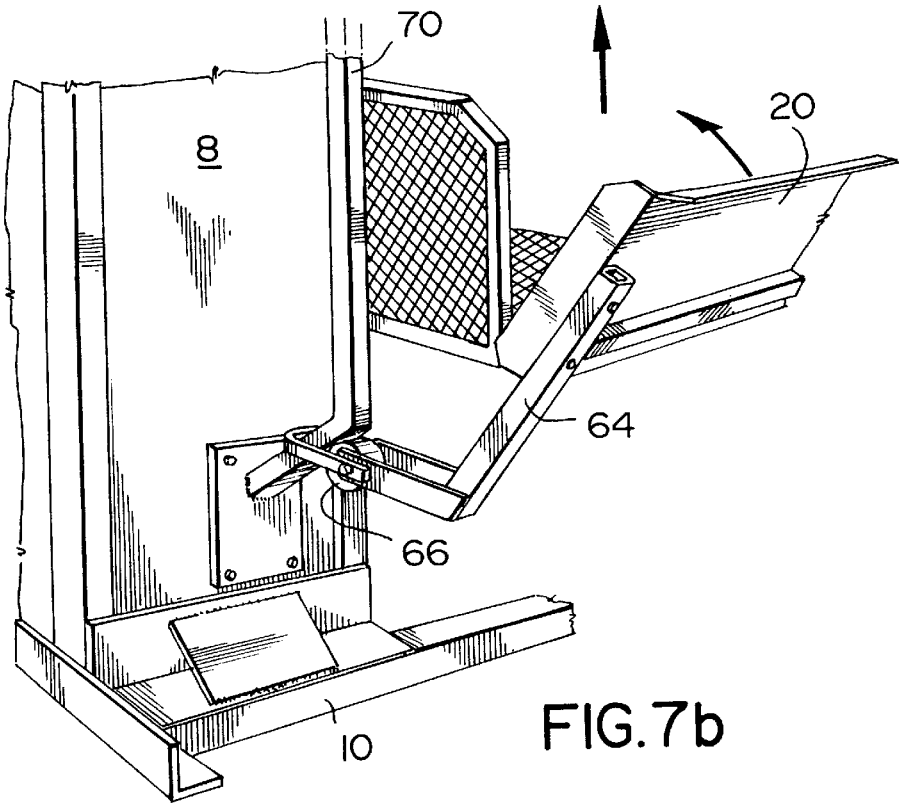
Figure 7C:
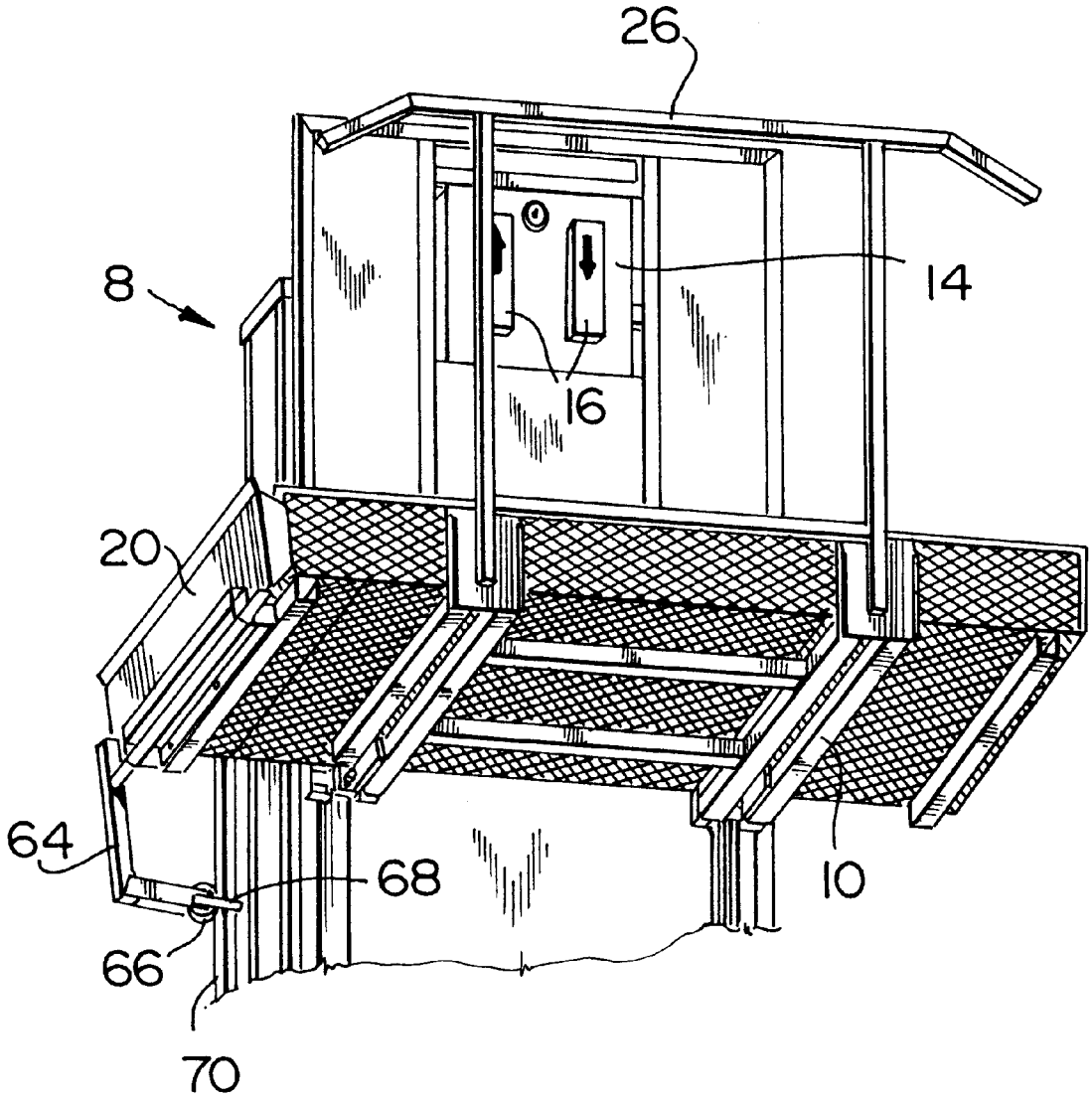

Yet another feature of the lift according to the present invention is the automatic operation of toe plate 20. This is illustrated in FIGS. 7*a* and 7*b*. Secured to toe plate 20 is a roller lever 64, at the free end of which is a roller 66 and roller strap 68. A guide rail 70 having the configuration as illustrated (FIG. 1) is secured to the side of tower 8 proximal to the side of carriage 12 to which toe plate 20 is pivotally secured, so that the outer periphery of guide rail 70 acts as a cam surface along which roller 66 will travel, thereby ensuring the lowering of toe plate to act as a ramp when carriage 12 reaches its lower position (FIG. 7*a*) and that toe plate 20 is in an upright (FIG. 7*b*), obstructing orientation while the carriage 12 is travelling between its lower and upper positions. Roller strap 68 circumscribes guide rail 70 to facilitate the travel of roller 66 along guide rail 70.

It will be understood that the lift 2 in accordance with the present invention is extremely economical to construct and easy to install. Unlike many of the more complicated lift structures known previously and illustrated in the prior art referred to above, little maintenance or adjustment of the lift components is required. As well, as can be seen in FIG. 1, lift 2 is free standing and requires no mechanical attachments to adjacent structures in order to function properly. The lift itself, with its zero load start feature and control pads and guide frame rollers, operates effectively in harsh external conditions as would be experienced in outdoors applications in cold climates.

Thus, it is apparent that there has been provided in accordance with the invention a vertical lift for use raising and lowering a person in exterior locations that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A free standing vertical lift for use in indoor/outdoor locations to raise and lower a person, the lift comprising a support frame, a tower frame mounted on the support frame, and a carriage secured to the tower frame so as to be vertically movable with respect thereto, a drive system associated with the tower frame to raise and lower the carriage between an upper and a lower position, and control means to enable a person using the lift to activate and deactivate the drive system as required, the tower frame comprising a plurality of vertically extending guides secured to the tower frame, a carriage guide frame secured to the carriage and movably associated with the guides, the drive system comprising a vertically oriented drive screw which, when activated, rotates in one direction to raise or in the opposite direction to lower a nut seated thereon so as not to rotate therewith, the guide frame supported by the nut for raising or lowering therewith.

2. In a vertical lift for use in exterior locations to raise and lower a person, the lift comprising a support frame, a tower frame mounted on the support frame, a carriage secured to the tower frame so as to be vertically movable with respect thereto, a drive system associated with the tower frame to raise and lower the carriage between an upper and a lower position, and control means to enable a person using the lift to activate and deactivate the drive system as required, the improvement characterized in that the tower frame includes a plurality of vertically extending guides secured to the tower frame and a carriage guide frame secured to the carriage and movably associated with the guides, and the drive system comprises a vertically oriented drive screw which, when activated, rotates in one direction to raise or in the opposite direction to lower a nut seated thereon so as not to rotate therewith, the guide frame supported by the nut for raising or lowering therewith, a folding toe plate secured to an edge of the carriage to provide a ramp for easy exit from and entry to the carriage, the toe plate being foldable between an upper position obstructing exit from and entry to the carriage, and a lower position flush with the upper surface of the platform, the toe plate being provided with means to automatically lift the toe plate to its upper position and hold it there while the carriage is between its upper and lower positions, and to automatically lower the toe plate when the carriage arrives at its lower position, the means to automatically lift and lower the toe plate comprising a roller lever secured to the toe plate and a cam surface on a guide bar on which the roller lever acts, the cam surface constructed so as to cause the roller lever to orient the toe plate in proper position depending upon the vertical position of the carriage.

3. A lift according to claim 2 wherein the guides comprise vertically oriented U-shaped channels and wherein the guide frame comprises plurality of vertically oriented roller arms, each of the roller arms seated in a different one of the guide channels for vertical movement.

4. A lift according to claim 3 wherein the channels are positioned, and their openings oriented towards the guide frame, so as to minimize horizontal movement of the guide frame.

5. A lift according to claim 2 provided with means to releasably secure the tower to the base frame and carriage to the carriage guide frame of the tower.

6. A lift according to claim 2 wherein the carriage comprises a horizontally oriented platform of expanded metal.

7. A vertical lift for use in exterior locations to raise and lower a person comprising a tower frame, a carriage movably mounted on the tower frame so as to be vertically movable with respect thereto, a drive system mounted to engage and raise and lower the carriage between an upper and a lower carriage position, and control means connected to the drive system for activating and deactivating the drive system, the drive system including a drive unit having a carriage engaging section to engage said carriage, said drive unit, when activated, operates in a first direction to raise or in a second opposite direction to lower the carriage engaging section to cause said carriage engaging section to engage and selectively raise and lower said carriage between the upper and lower carriage positions, and means to cause said drive unit to operate in the second direction after said carriage reaches the lower carriage position to disengage said carriage engaging section from said carriage to enable said drive unit to subsequently operate for a short period in the first direction before said carriage engaging section engages said carriage.

8. A lift according to claim 7 wherein the control means are mounted on the tower so as to move with the carriage up and down relative to the tower.

9. A lift according to claim 8 further comprising electrical control means for the drive system and wherein the controls comprise separate control switches for governing up and down movement of the carriage.

10. A lift according to claim 7 wherein a folding toe plate is secured to an edge of the carriage to provide a ramp for easy exit from and entry to the carriage, the toe plate foldable between an upper position obstructing exit from and entry to the carriage, and a lower position flush with the upper surface of the platform.

11. A lift according to claim 10 wherein the toe plate is provided with means to automatically lift the toe plate to its upper position and hold it there while the carriage is between its upper and lower positions, and to automatically lower the toe plate when the carriage arrives at its lower position.

12. A lift according to claim 7 wherein the controls means further comprise an emergency stop switch which, when activated, overrides the up and down controls and prevents power from being supplied to the drive screw.

13. The vertical lift of claim 7 wherein said means to cause said drive unit to operate in the second direction after said carriage reaches the lower carriage position includes a control switch mounted on the tower frame to be engaged by said carriage engaging section after said carriage engaging section is disengaged from said carriage, said control switch being connected to said drive unit.

14. In a vertical lift for use in exterior locations to raise and lower a person, the lift comprising a support frame, a tower frame mounted on the support frame, a carriage secured to the tower frame so as to be vertically movable with respect thereto, a drive system associated with the tower frame to raise and lower the carriage between an upper and a lower position, and control means to enable a person using the lift to activate and deactivate the drive system as required, the improvement characterized in that the tower frame includes a plurality of vertically extending guides secured to the tower frame and a carriage guide frame secured to the carriage and movably associated with the guides, and the drive system comprises a vertically oriented drive screw which, when activated, rotates in one direction to raise or in the opposite direction to lower a nut seated thereon, means provided on the guide frame to prevent rotational movement of the nut during rotation of the drive screw, the guide frame being supported by the nut for raising or lowering therewith, and a stop to prevent further lowering of the guide frame when the carriage has reached its lower position and a means is provided to continue rotation of the drive screw in one direction and lower the nut further, beyond its lowest position supporting the guide frame, after the carriage has reached that lower position, to enable rotation of the drive screw in the opposite direction and raising of the nut for a short period of time before the nut comes into a position supporting the guide frame, whereby a zero load start for the drive screw is provided when lifting the guide frame and carriage.

15. A lift according to claim 14 wherein a switch means is associated with the drive screw and nut to deactivate rotation of the drive screw in said one direction after the nut has been lowered sufficiently on the drive screw to provide the zero load start when the drive screw is activated to lift the guide frame and carriage.

16. In a vertical lift for use in exterior locations to raise and lower a person, the lift comprising a support frame, a tower frame mounted on the support frame, a carriage secured to the tower frame so as to be vertically movable with respect thereto, a drive system associated with the tower frame to raise and lower the carriage between an upper and a lower position, and control means to enable a person using the lift to activate and deactivate the drive system as required, the improvement characterized in that the tower frame includes a plurality of vertically extending guides secured to the tower frame and a carriage guide frame secured to the carriage and movably associated with the guides, and the drive system comprises a vertically oriented drive screw which, when activated, rotates in one direction to raise or in the opposite direction to lower a nut seated thereon so as not to rotate therewith, the guide frame being supported by the nut for raising or lowering therewith, and control means mounted on the tower so as to move with the carriage up and down relative to the tower, said control means including electrical control means for the drive system which include separate control switches for governing up and down movement of the carriage, the up and down switches each being biased to one position and those switches operate to activate the drive system only when they are held, against the bias, in another position.

17. A lift according to claim 16 wherein lever pads cover the up and down control switches and minimize exposure of those switches to precipitation and other environmental conditions, the lever pads and switches arranged to require depression of a lever pad for movement of its associated switch from said first to said other position.

18. A lift according to claim 17 wherein the switches are secured to a control panel and wherein the lever pads are pivotally secured to the lever panel, above its corresponding switch, to depend down over, and bear upon the switch.

19. In a vertical lift for use in exterior locations to raise and lower a person, the lift comprising a support frame, a tower frame mounted on the support frame, a carriage secured to the tower frame so as to be vertically movable with respect thereto, a drive system associated with the tower frame to raise and lower the carriage between an upper and a lower position, and control means to enable a person using the lift to activate and deactivate the drive system as required, the improvement characterized in that the tower frame includes a plurality of vertically extending guides secured to the tower frame and a carriage guide frame secured to the carriage and movably associated with the guides, and the drive system comprises a vertically oriented drive screw which, when activated, rotates in one direction to raise or in the opposite direction to lower a nut seated thereon so as to not to rotate therewith, the guide frame being supported by the nut for raising or lowering therewith, and control means mounted on the tower so as to move with the carriage up and down relative to the tower, said control means including electrical control means for the drive system which include separate control switches for governing up and down movement of the carriage, the control means further comprising a lock means which, when locked, prevents activation of the drive system and thereby prevents unwanted use of the lift.

* * * * *